US005823831A

United States Patent [19]

Bowater et al.

[11] Patent Number: 5,823,831

[45] Date of Patent: Oct. 20, 1998

[54] BATTERY TERMINAL CONNECTOR

[76] Inventors: Barry Thomson Bowater, 94 Reservoir Road, Sunbury, Victoria 3429; Garry John Owen, 74-76 Hattam Street, Golden Square, Bendigo 3555, both of Australia

[21] Appl. No.: 591,604

[22] PCT Filed: Aug. 12, 1994

[86] PCT No.: PCT/AU94/00471

§ 371 Date: Apr. 29, 1996

§ 102(e) Date: Apr. 29, 1996

[87] PCT Pub. No.: WO95/05687

PCT Pub. Date: Feb. 23, 1995

[30] Foreign Application Priority Data

| | | | |
|---|---|---|---|
| Aug. 12, 1993 | [AU] | Australia | PM0514 |
| Dec. 15, 1993 | [AU] | Australia | PM2963 |

[51] Int. Cl.[6] ..... H01R 4/50

[52] U.S. Cl. ..... 439/773

[58] Field of Search ..... 439/754, 760, 439/761, 769, 770, 772, 773, 774, 758, 762, 763, 764, 765, 766, 767, 757, 864, 726

[56] References Cited

U.S. PATENT DOCUMENTS

| | | | |
|---|---|---|---|
| 2,045,590 | 6/1936 | Emery | 439/761 |
| 4,555,159 | 11/1985 | Chartrain et al. | 439/772 |
| 4,695,118 | 9/1987 | Magdesyan et al. | 439/726 |

*Primary Examiner*—P. Austin Bradley
*Assistant Examiner*—Barry M. L. Standig
*Attorney, Agent, or Firm*—Blakely Sokoloff Taylor & Zafman

[57] ABSTRACT

A battery terminal connector which can be removed and connected securely without a tool, and is simple both in use and in construction is disclosed. The battery terminal connector comprises a body that receives a battery terminal and a cam shaft rotatable within the body for engaging the terminal to lock the connector to the terminal. The cam shaft on rotation between an unlock and lock position pulls the body downwards onto the terminal and moves laterally across the terminal to lock the connector to the terminal.

13 Claims, 3 Drawing Sheets

BATTERY TERMINAL CONNECTOR

BACKGROUND OF THE INVENTION (1) Field of the Invention

The present invention relates to a battery terminal connector.

(2) Prior Art

Battery leads for vehicle batteries are normally fixed to terminals of the battery using clamps which have screws that act to open or close the clamps. Whilst the terminal clamps provide a secure and good electrical contact with the battery terminals for the leads, a tool is required to remove and attach the clamps and the connection and disconnection process is cumbersome. This is disadvantageous for a number of reasons, such as the following:

1. The clamps on vehicle batteries should be periodically removed to avoid the accumulation of corrosive material which prevents the electrical connection between the terminals and the leads being maintained, and can also damage the terminals. This is discouraged by clamps which are difficult to remove and reconnect.
2. Touring and camping equipment are now available which rely on power from a vehicle battery. The battery needs to be removed from a vehicle for use with the equipment, yet this becomes a significant annoyance when the equipment is moved frequently. Also if the necessary tool is mislaid during a trip, then the battery can no longer be removed.
3. It may be necessary to disconnect the terminal clamps to either remove the battery or perform maintenance in situations where the necessary tool is not available or is difficult to use. For example, maintenance or removal of a battery may need to be affected on the side of a road at night without adequate lighting.

Accordingly a battery terminal connector which can be removed and connected securely without a tool and is simple both in use and in construction, is required.

SUMMARY OF THE INVENTION

In accordance with the present invention there is provided a battery terminal connector comprising:

a body having means for receiving a battery terminal; and a cam shaft rotatable within said body for engaging said terminal to lock the connector to said terminal.

Advantageously, in the preferred embodiment, the cam shaft on rotation between an unlock and lock position pulls said body downwards onto said terminal and moves across said terminal to lock said connector to said terminal.

BRIEF DESCRIPTION OF THE INVENTION

A preferred embodiment of the present invention is hereinafter described, by way of example only, with reference to the accompanying drawings, wherein.

DETAILED DESCRIPTION OF THE INVENTION

Figure 1:
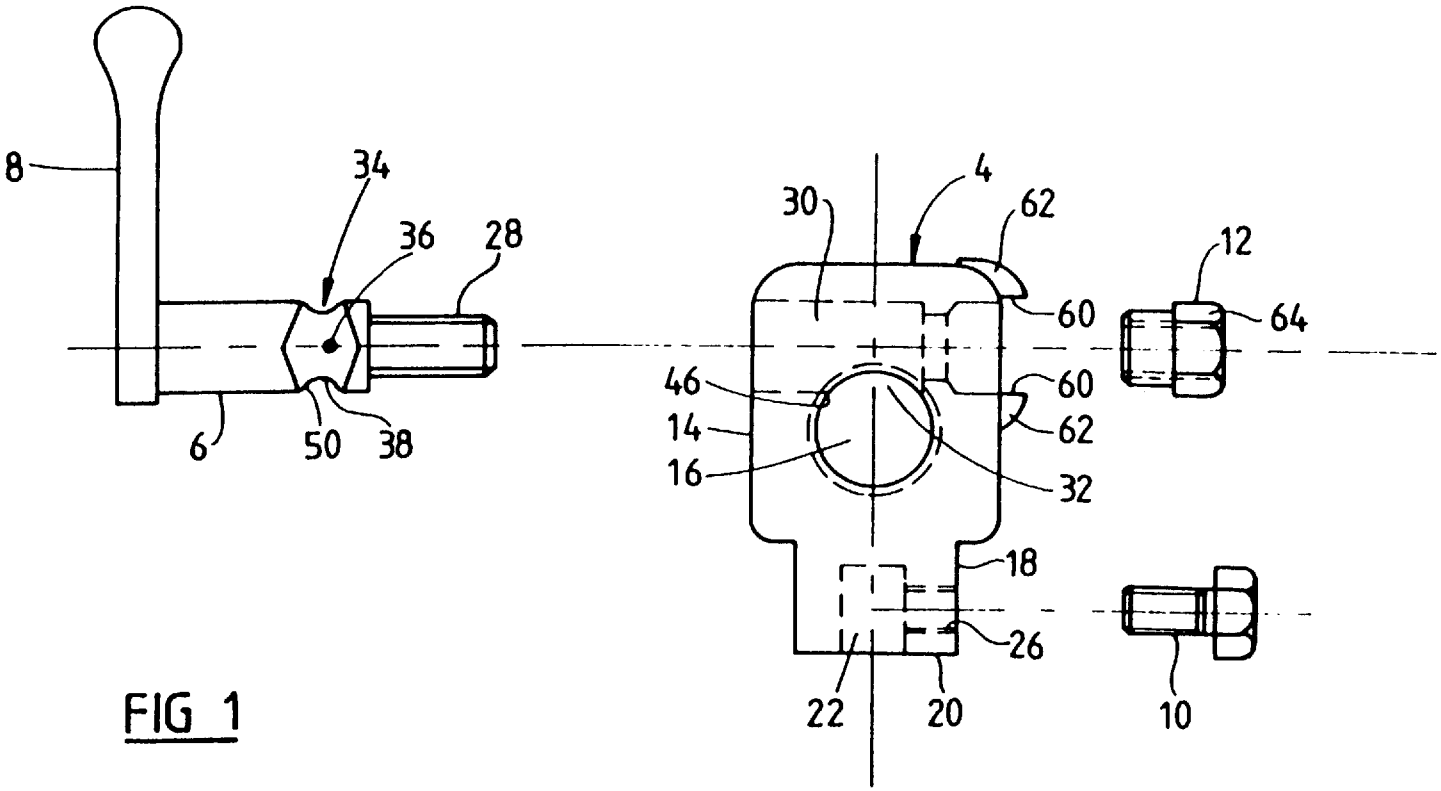
FIG. 1 is an exploded view of a preferred embodiment of a battery terminal clamp.

A battery terminal clamp 2, as shown in the Figures, includes a body 4, a cam shaft 6, lever 8, a screw 10 and a nut 12 with a left hand thread. The body 4 comprises a rectangular block 14 with a central hole 16, and a protruding part 18 which is bored at its end face 20 so as to form a lead hole 22 for receiving the end of a battery lead 24 within the body 4. The end of the battery lead is clamped to the protruding part 18 of the body 4 by the screw 10 which can be screwed within a threaded bore 26 which extends between a side of the protruding part 18 and the lead hole 22. The screw 10 is an M6 hexagonal HD bolt screw. The central hole 16 extends between the top and bottom of the body 4.

Figure 2:
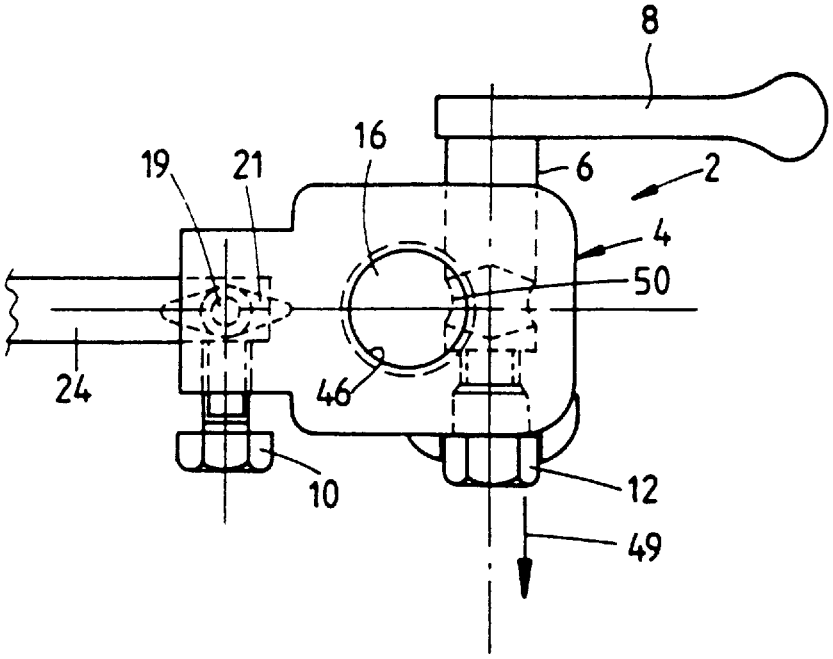
FIG. 2 is a plan view of the battery terminal clamp.
Figure 3:
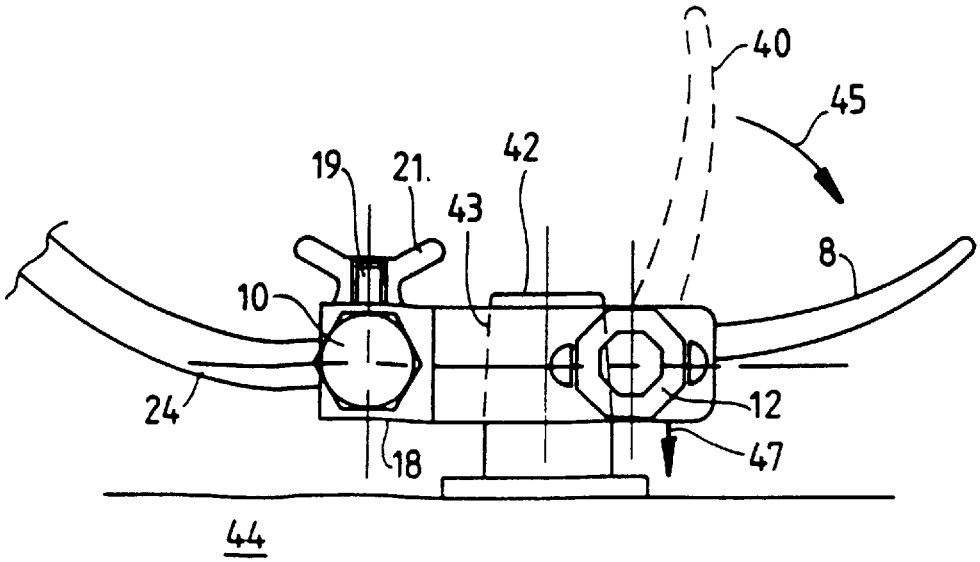
FIG. 3 is a side view of the battery terminal clamp.
Figure 4:
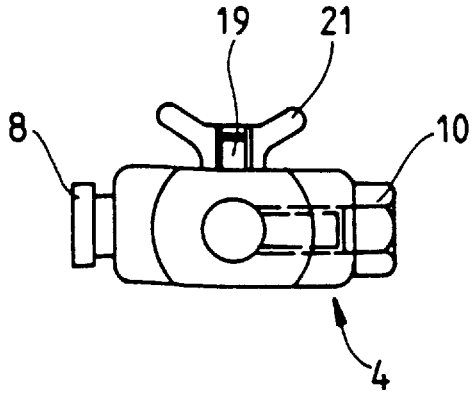
FIG. 4 is an end view of the battery terminal clamp.

The projecting part 18 further includes a M8 threaded stud 19 mounted on top of the part 18, as shown in FIGS. 2 to 4, and a wing nut 21 can be screwed onto the stud 19 so as to clamp accessory leads to the body 4, as desired.

The cam shaft 6 has a lever arm 8 attached to one end and at the other end includes an M8 left hand thread 28. Near the end of the body 4 opposite the protruding part 18, a stepped bore 30 extends between the sides of the body 4 and through a segment 32 of the hole 16. The bore 30 is cut so as to receive the cam shaft 6 from one side and the nut 12 from the other, with the thread 28 of the cam shaft 6 being received by the nut 12. The nut 12 is a hexagonal nut with an M8 left hand thread. The bore 30 allows the cam shaft 6 to be screwed into the nut 12 whilst the nut 12 remains in position. The shaft 6 includes a recessed cam part 34 which when inserted into the bore 30 is aligned with the centre of the hole 16. The cam part 34 includes an eccentric surface which has a major recess 36 and a minor recess 38, spaced approximately 45° apart. The surface of the cam part 34 tapers inwardly from the surface of the shaft 36, as shown in FIGS. 1 and 2.

The lever 8 can be used to rotate the shaft 6 between a locked position, as shown in FIGS. 2 and 3, where the lever 8 is almost aligned with the plane of the body 4, and an unlocked position where the lever 8 is substantially perpendicular to the plane of a body 4, as shown by the dotted lines 40 in FIG. 3. The central hole 16 of the body 4 is provided so as to receive a battery terminal 42 of a vehicle battery 44. The battery terminal 42 has a tapered surface 43 which expands slightly from top to bottom of the terminal 42. With the cam lever 8 placed in the unlocked position, the major recess 36 of the cam part 34 faces into the hole 6 and its surface is aligned with the walls 46 of the hole 16. The battery terminal 42 can therefore be received within the hole 16 and the body 4 placed on thee terminal 42 when the cam lever 8 is placed in the unlocked position. On inserting the body 4 onto the terminal 42, the cam lever 8 can then be moved into the locked position so as to rotate the cam part 34 such that the minor recessed portion 38 thereof engages the battery terminal 42 and clamps the terminal 42 onto the walls 46 of the hole 16. In moving the lever 8 from the unlocked position to the locked position in a direction 45 rotates the cam shaft 6 in the same direction so that the engaging surface of the cam part 34 acts on the tapered surface 43 of the terminal 42 to pull the body 4 in the downward direction 47. This action assists in enhancing the clamping engagement between the cam part 34, body 4, and the tapered surface 43 of the post 42 as the cam part 34 is pulled down onto an increased diameter portion of the tapered surface 43. Moving the lever 8 into the locked position also rotates the cam shaft 6 so as to screw the shaft 6 into the nut 12 and thereby move the cam shaft 6 in towards the nut 12 in a direction 49, as shown in FIG. 2. This causes the surface of the cam part 34 to move across the surface 43 of the battery terminal 42 so as to heighten the clamping engagement between the cam part 34, body 4, and the surface 43 by pulling an increased diameter part 50 of the cam part 34 onto the surface 43 of the battery terminal 42. This assists in securing the cam shaft 6 in the locked position and maintaining the clamp connection between the terminal clamp 2 and the battery terminal 42. The heightened engagement between the nut 12 and the cam shaft 6 also prevents any sustained vehicle vibrations working the clamping engagement between the cam shaft 6 and the terminal 42 loose.

In the locked position the lever 8 is disposed behind the body 4 so as not to interfere with any adjacent clamps or terminals. The engagement between the nut 12 and the cam shaft 6 can also be adjusted to index or set the locked and unlocked positions of the lever 8 as desired. The nut 12 is held in an index position by the abutting surfaces 60 of protrusions 62 on the body 4. The abutting surfaces 60 inhibit notation of the hexagonal shaped head 64 of the nut 12. For every indexed position, a pair of opposing surfaces of the head 64 abut the abutting surfaces 60. Another index position is simply chosen by unscrewing the shaft 6 by an amount which allows the head 64 to be moved clear of the surfaces 60 so that it can be rotated and then moved back within the bounds of the surfaces 60 so as to present a different pair of surfaces of the head 64 to face the abutting surfaces 60.

The body may be cast from rigid conductive material, such as alloy steel, or any other material, such as plastics, provided a conductive material portion is included to electrically connect the lead 24 and the terminal 42.

The battery clamp 2 provides a simple and effective means of connecting battery leads to terminals of a vehicle battery. The number of parts employed in the clamp 2 is minimal, thereby providing a clamp which in addition to being simple to use is simple and inexpensive to construct. A secure connection can be made and disengaged by simple movement of a lever, and without requiring an additional tool. The battery clamp 2 also provides a safety advantage in that in the event of an electrical short in a vehicle's electrical circuitry, which may cause a fire, the clamp 2 can be quickly removed to disconnect battery power.

We claim:

1. A battery terminal connector comprising:

a body having means for receiving a battery terminal; and a cam shaft rotatable within said body for engaging said terminal to lock the connector to said terminal, wherein said cam shaft on rotation between an unlock and lock position pulls said body downwards into said terminal and moves laterally across said terminal to lock said connector to said terminal.

2. A battery terminal connector as claimed in claim 1, wherein said receiving means is a hole in said body.

3. A battery terminal connector as claimed in claim 1, including means for moving said cam shaft laterally across said terminal during said rotation.

4. A battery terminal connector as claimed in claim 3, wherein said cam shaft has a tapered surface for engaging said terminal.

5. A battery terminal connector as claimed in claim 4, wherein said moving means includes nut means which receives a threaded portion of said cam shaft.

6. A battery terminal connector as claimed in claim 5, wherein said body inhibits rotation of said nut means.

7. A battery terminal connector as claimed in claim 6, wherein said nut means has a plurality of positions which can be selected to select said unlock and lock positions.

8. A battery terminal connector as claimed in claim 7, wherein said cam shaft includes a lever arm to rotate said cam shaft between said unlock and lock positions.

9. A battery terminal connector as claimed in claim 1, wherein the body includes means for connecting battery leads thereto.

10. A battery terminal connector as claimed in claim 2, wherein the body includes means for receiving a battery lead, and clamp means for clamping the lead to said body.

11. A battery terminal connector as claimed in claim 10, wherein the clamp means includes a bolt which can be screwed into the body.

12. A battery terminal connector as claimed in claim 11, including nut means on the body for connecting accessory leads to the body.

13. A battery terminal connector as claimed in any one of the preceding claims, wherein said body includes means for electrically connecting said terminal to a battery lead attached to the body when said connector is locked on said terminal.

* * * * *